US007328688B2

(12) United States Patent
Savage et al.

(10) Patent No.: US 7,328,688 B2
(45) Date of Patent: Feb. 12, 2008

(54) FLUID PUMPING APPARATUS, SYSTEM, AND METHOD

(75) Inventors: Howard S. Savage, Columbus, IN (US); Wesley R. Thayer, Columbus, IN (US)

(73) Assignee: Cummins, Inc, Columbus, IN (US)

( * ) Notice: Subject to any disclaimer, the term of this patent is extended or adjusted under 35 U.S.C. 154(b) by 242 days.

(21) Appl. No.: 11/151,927

(22) Filed: Jun. 14, 2005

(65) Prior Publication Data

US 2006/0278198 A1 Dec. 14, 2006

(51) Int. Cl.
*F02M 57/02* (2006.01)

(52) U.S. Cl. ..... 123/446; 123/506

(58) Field of Classification Search ..... 123/506, 123/446–447, 497; 417/505
See application file for complete search history.

(56) References Cited

U.S. PATENT DOCUMENTS 3,738,578 A * 6/1973 Farrell ..... 239/585.4
3,772,540 A * 11/1973 Benson ..... 310/14
4,026,322 A 5/1977 Thomas ..... 137/512
4,398,562 A * 8/1983 Saarem et al. ..... 137/625.47
4,416,591 A * 11/1983 Horwinski ..... 417/241
4,545,353 A * 10/1985 Gmelin et al. ..... 123/454
4,619,239 A * 10/1986 Wallenfang et al. ..... 123/506
4,648,368 A * 3/1987 Gmelin et al. ..... 123/454
4,951,878 A * 8/1990 Casey et al. ..... 239/462
5,312,050 A * 5/1994 Schumann et al. ..... 239/585.1
5,407,131 A * 4/1995 Maley et al. ..... 239/90
5,494,219 A * 2/1996 Maley et al. ..... 239/88
5,626,325 A * 5/1997 Buchanan et al. ..... 251/129.14
5,636,975 A 6/1997 Tiffany et al. ..... 417/454
5,921,526 A * 7/1999 Najmolhoda ..... 251/65
5,924,853 A 7/1999 Pacht ..... 417/567
5,947,442 A * 9/1999 Shurman et al. ..... 251/129.19
5,996,628 A * 12/1999 Najmolhoda et al. .. 137/625.61
6,138,923 A 10/2000 Nakano et al. ..... 239/88
6,447,273 B1 9/2002 Nishimura et al. ..... 417/505
6,485,593 B1 11/2002 Christoffersen ..... 156/158
6,834,169 B2 12/2004 Hren et al. ..... 399/82
2002/0092507 A1 7/2002 Potschin et al. ..... 123/506
2003/0019531 A1* 1/2003 Satoh ..... 137/625.65
2003/0037765 A1* 2/2003 Shafer et al. ..... 123/321
2004/0020467 A1* 2/2004 Leman et al. ..... 123/467
2004/0105763 A1 6/2004 Kondo ..... 417/273
2004/0220553 A1* 11/2004 Olsen ..... 604/891.1

* cited by examiner

*Primary Examiner*—Thomas Moulis
(74) *Attorney, Agent, or Firm*—Kunzler & McKenzie

(57) ABSTRACT

A fluid pumping apparatus, system, and method are disclosed in which an apparatus according to one embodiment of the invention comprises a housing, an inlet through which the fluid enters the housing, an outlet through which the fluid leaves the housing, a valve comprising a valve member and a valve seat, the valve being positioned between the inlet and the outlet such that the fluid from the inlet must flow through the valve to reach the outlet, and a magnet mechanism, configured to exert a continuous magnetic force. The magnet mechanism is positioned to continuously urge the valve member into a first position. System and method embodiments are also disclosed.

27 Claims, 5 Drawing Sheets

FLUID PUMPING APPARATUS, SYSTEM, AND METHOD

BACKGROUND OF THE INVENTION

1. Field of the Invention

This invention relates to fluid pumping apparatuses, systems and methods, and more particularly to high-pressure pumps intended for use with common-rail fuel injection systems.

2. Description of the Related Art

Most fluid pumps have of necessity chambers and valves to move the fluid through the pump as it is pressurized and/or depressurized. The valves generally consist of a valve member and a biasing force imparted by means of a spring or spring assembly that continuously urges the valve member against a valve seat. To move the fluid through the valve, the valve is opened by moving the valve member away from the valve seat through the application of a momentary hydraulic, mechanical, electromagnetic or other force that overcomes the continuous biasing force. After fluid movement through the valve, the valve is closed by easing the momentary force and allowing the biasing force to close the valve member against the valve seat. A common example of this are solenoid valves, which use a spring to keep the valve member biased against the valve seat. The valve member is momentarily moved away from the valve seat through activation of the solenoid, which imparts an electromagnetic force that acts oppositely of and overcomes the spring's biasing force. Other valves use the pressure of the fluid itself to overcome the force of the spring, either through positive pressure (pressurization of the fluid) or negative pressure (depressurization of the fluid).

In some systems, particularly some fuel injectors and similar devices, the biasing force continuously urges the valve open, which is then momentarily closed by means of the oppositely directed hydraulic or electromagnetic force.

The particular area to which one embodiment of the invention pertains is common-rail fuel injection systems, widely used in diesel engines. These systems utilize high pressures with commensurate stresses on the system, and improved forms of the injection systems utilize higher pressures still. Among other things, these pressures cause problems with internal drilling intersections, which provide stress concentrations that reduce pressure and durability limits through stress fractures and the like. A particular instance of this would be a pump which contains an intake valve through which fuel is directed from an intake into a pressurizing chamber, and an outtake valve located adjacent the intake valve through which fuel is directed from the pressurizing chamber to an outtake discharge. The drilling intersections into the pressurizing chamber required to locate the intake and outtake valves in such a fashion create undesirable stress concentrations.

In many cases, the pump or pumps that supply fuel to the common rail must be capable of delivering fuel at a level of 1800 bar (about 26,000 psi) or higher. Various pump constructions and pumping methods are used to do this, each of them with their strengths and weaknesses. Many current pumps use 8-millimeter-diameter or 10-millimeter-diameter pumping or pressurizing plungers, with a 10- to 13-millimeter plunger stroke. The fuel moves from the common rail to the fuel injectors themselves for injection into the cylinders.

In pumping fuel from a fuel supply to a common rail, and in other systems where pumps are used, springs and similar mechanical devices that bias valves in their default positions complicate the system, providing additional mechanical moving parts that are subject to wear, maintenance, and replacement due to the high-pressure fuel moving through the system, rapid and repeated movement of the valves, and other stresses. As they experience wear, springs in this environment can generate debris that negatively affects the system. Springs experience fatigue, and wear on a spring can change its force characteristics. A spring's resonant frequency can also affect the system's operation.

From the foregoing discussion, it is apparent that a need exists for an improved apparatus, system, and method for pumping fluids.

SUMMARY OF THE INVENTION

The present invention has been developed in response to the present state of the art, and in particular in response to problems and needs in the art that have not yet been fully solved. While one embodiment of the invention particularly concerns high-pressure fuel pumping systems, additional embodiments and applications in other fluid-pumping areas will be apparent to those skilled in the art.

In one embodiment, an apparatus according to the present invention comprises a housing, an inlet through which the fluid enters the housing, and an outlet through which the fluid leaves the housing. A valve, made up of a valve member and a valve seat, is positioned between the inlet and the outlet such that fluid from the inlet must flow through the valve to reach the outlet. A magnet mechanism, configured to exert a continuous magnetic force, is positioned to continuously urge the valve member into a first position—in one embodiment, against the valve seat. The magnet mechanism may comprise one or more permanent magnets.

In one embodiment of the apparatus, a permanent magnet is disposed on the valve member. An attractor, exerting an attractive force on the permanent magnet, is positioned within the apparatus such that the valve seat is positioned substantially between the permanent magnet and the attractor, urging the valve member against the valve seat. The attractor may comprise a second permanent magnet, and the positions of the permanent magnet and the attractor may be reversed.

In place of the attractor, one embodiment of the invention may comprise a repeller, configured to exert a repellent force on the permanent magnet. In this configuration, the permanent magnet may be disposed on the valve member substantially between the repeller and the valve seat, such that the valve member is urged against the valve seat. The positions of the repeller and the permanent magnet may be reversed. The repeller may consist of a second permanent magnet. The repeller may also be used in addition to the attractor.

In a system embodiment of the present invention, a high-pressure common-rail fuel injection pumping system comprises a pump housing, a fuel inlet through which the fuel enters the housing, and a fuel outlet through which the fuel leaves the housing. A common rail is attached to the fuel outlet in fluid engagement such that the common rail receives high-pressure fuel from the fuel outlet. A plurality of injectors receive fuel from the common rail and inject the fuel into an engine. A valve, made up of a valve member and a valve seat, is positioned between the fuel inlet and the fuel outlet such that the fuel from the fuel inlet must flow through the valve to reach the fuel outlet. A magnet mechanism, configured to exert a continuous magnetic force, is positioned within the system to continuously urge the valve member into a first position.

A method of the present invention presented in the disclosed embodiments substantially includes the steps necessary to carry out the functions presented above with respect to the operation of the described apparatus and system. In one embodiment, the method comprises providing a first fluid chamber, a second fluid chamber, a passage disposed between the first and second fluid chambers, and a magnetic force continuously urging the passage closed. The passage is then opened against the influence of the magnetic force, allowing for fluid communication between the first fluid chamber and the second fluid chamber. The fluid is transported from the first fluid chamber to the second fluid chamber; and the passage is closed least partially under the influence of the magnetic force.

Reference throughout this specification to features, advantages, or similar language does not imply that all of the features and advantages that may be realized with the present invention should be or are in any single embodiment of the invention. Language referring to the features and advantages should be understood to mean that a specific feature, advantage, or characteristic described in connection with an embodiment is included in at least one embodiment of the present invention. Discussion of the features and advantages and similar language throughout this specification may, but do not necessarily, refer to the same embodiment. In addition, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

The features and advantages of the present invention will become more fully apparent from the following description and appended claims, or may be learned by the practice of the invention as set forth below.

BRIEF DESCRIPTION OF THE DRAWINGS

A more particular description of the invention summarized above will be rendered by reference to specific embodiments illustrated in the appended drawings—understanding that the drawings depict only certain embodiments of the invention and are not to be considered to be limiting of its scope—wherein.

DETAILED DESCRIPTION OF THE INVENTION

Figure 1:
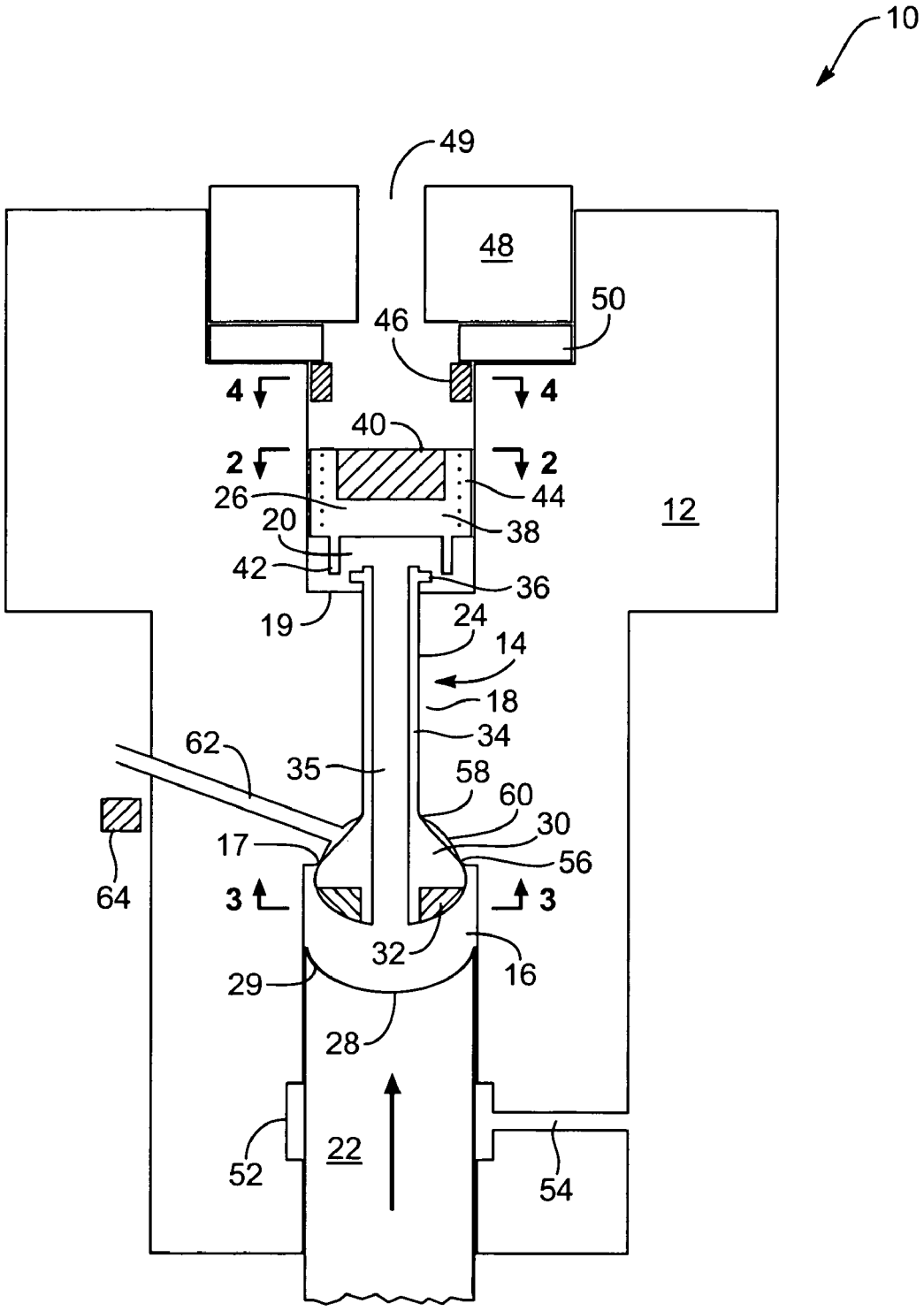
FIG. 1 is a cross-sectional view illustrating one embodiment of a high-pressure fuel pump apparatus in accordance with the invention, with the pump in pressurizing mode.

It will be understood that the components of the present invention, as generally described and illustrated in the figures herein, may be arranged and designed in a wide variety of different configurations. Thus, the following, more detailed, description of the embodiments of the apparatus, system, and method of the present invention is not intended to limit the scope of the invention as claimed, but is merely representative of selected embodiments.

The illustrated embodiments of the invention will be best understood by reference to the drawings, wherein like parts are designated by like numerals throughout. Those of ordinary skill in the art will appreciate that various modifications to the devices, systems, and processes may readily be made without departing from the essential characteristics of the invention. Thus, the following description is intended only by way of example, illustrating certain selected embodiments of devices, systems, and processes that are consistent with the invention as claimed herein.

In describing the construction and operation of certain embodiments of the invention, it should be understood that the terms "down" and "up" and similar terms are used only for convenience in referring to the drawings and do not necessarily indicate the spatial orientation of the embodiments in actual operation.

Referring first to FIG. 1, one embodiment of the invention comprises a pump 10, which takes fuel from a fuel supply (not shown) and delivers it to a common rail (also not shown), to provide pressure for fuel injectors injecting fuel into the cylinders of an engine. The pump has a housing 12 and a central bore 14. The central bore 14 generally comprises three sections: a pressurizing chamber 16; a passage 18; and an outlet chamber 20. The pressurizing chamber 16, outlet chamber 20, and passage 18 are substantially cylindrical, and the passage 18 is disposed between and connects the pressurizing chamber 16 and the outlet chamber 20. The passage 18 is radially smaller than the pressurizing chamber 16, thus forming an inlet step 17 where the two are conjoined. The passage 18 is also radially smaller than the outlet chamber 20, forming an outlet step 19 where the two are conjoined. The inlet step 17 and outlet step 19 figure in the seating and unseating of valves, further described below.

A pressurizing plunger 22 is positioned within the pressurizing chamber 16 and is adapted for axially reciprocating movement therein under the impetus of a cam-driven tappet (not shown) run off the engine, or other means that will be apparent to those skilled in the art. An inlet plunger 24 is disposed through the passage 18 as well as partially within both the pressurizing chamber 16 and outlet chamber 20. An outlet plunger 26 is disposed within the outlet chamber 20. The pressurizing plunger 22, inlet plunger 24, and outlet plunger 26 are substantially cylindrical in one embodiment, with further structure as described below.

The pressurizing plunger 22 is connected at one end (not shown) to the cam or other device that helps drive its reciprocating movement within the pressurizing chamber 16. The other end 28 of the pressurizing plunger 22, the end 28 being positioned within the pressurizing chamber 16, is concave in shape. The concave shape of the end 28 provides for a superior seal between the pressurizing plunger 22 and the walls of the pressurizing chamber 16. As fluid within the pressurizing chamber 16 is pressurized and pressed outward, the outward radial portion of the end 28 is pressed against the walls of the pressurizing chamber 16, providing for a seal superior to that of a flat pressurizing plunger end.

Figure 3:
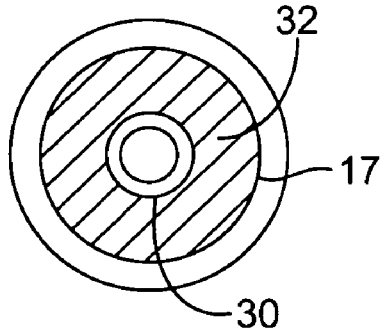
FIG. 3 is a partial cross-sectional view along line 3-3 of FIG. 1, showing the inlet plunger bulb and magnet of the pump apparatus.

Referring now to FIGS. 1 and 3, the inlet plunger 24 comprises a shaft 34 that extends through and is fitted snugly against the wall of the central passage 18. The inlet plunger 24 also comprises a seating end or bulb 30 that is disposed on one end of the shaft 34 and positioned substantially within the pressurizing chamber 16. The bulb 30 is generally axially larger than the shaft 34 and configured to accommodate an annular magnet 32 positioned on one end, the annular magnet 32 helping create a valve seal as further detailed below. With the snug fitting of the shaft 34 within the central passage 18, the passage 18 guides the shaft 34, helping prevent it from becoming twisted or otherwise deformed. The fit also helps keep the movement of the shaft 34 uniform. The large surface engagement between the shaft 34 and central passage 18 also help minimize fuel leakage between them.

A channel 35 extends through the inlet plunger bulb 30 and shaft 34, providing for fluid communication between the pressurizing chamber 16 and the outlet chamber 20. A stroke limiter 36 is disposed on the opposite end of the inlet plunger shaft 34 from the bulb 30, limiting the extent of the reciprocating movement of the inlet plunger 24.

Figure 2:
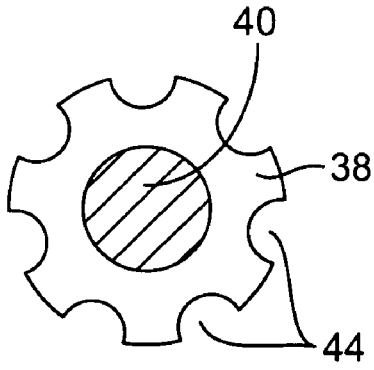
FIG. 2 is a partial cross-sectional view along line 2-2 of FIG. 1, showing the outlet plunger body, magnet, and passages of the pump apparatus.

Referring to FIGS. 1 and 2, the outlet plunger 26 comprises a body 38, which contains a cavity into which a magnet 40 is positioned. A seating annulus 42 is disposed at the opposite end of the outlet plunger body 38 from the magnet 40. The sealing annulus 42 is adapted to abut the step 19 in sealing engagement, blocking the flow of fluid from the inlet plunger channel 35. Thus the outlet plunger 26 forms a valve member, with the outlet step 19 forming a valve seat, the two together forming an outlet valve. A plurality of outlet passages 44 are formed on the radial outside surface of the outlet plunger body 38, forming elongated channels between the outlet plunger 26 and the walls of the outlet chamber 20.

The magnet 40 is oriented to be attracted to the magnet 32 positioned on the inlet plunger bulb 30—in other words, their poles are aligned axially, such that the south pole of the magnet 40 is positioned nearest the north pole of the magnet 32, or vice versa. With the magnets 40 and 32 exerting a continuous attractive force, the outlet plunger 26 and inlet plunger 24 are continually urged toward one another, though the continuous force is periodically overridden by hydraulic or fluid pressure as described in further detail below. Thus, the outlet plunger magnet 40 serves as an attractor to the inlet plunger magnet 32 and vice versa.

Figure 4:
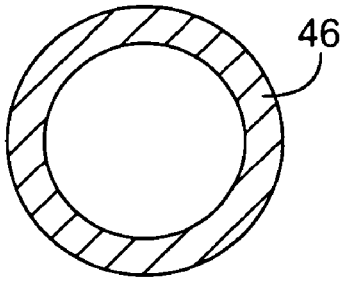
FIG. 4 is a partial cross-sectional view along line 4-4 of FIG. 1, showing the repelling magnet of the pump apparatus.

Referring now to FIGS. 1 and 4, an annular repelling magnet 46, oriented to repel the outlet plunger magnet 40, is disposed at the top of the outlet chamber 20. Thus the outlet plunger 26 is urged toward the inlet plunger 24, as well as against the outlet step 19, by two means: the attractive force between the magnets 40 and 32 and the repelling force between the magnets 40 and 46, the magnets 40 and 46 serving as repellers to one another.

The magnets 32, 40, and 46 are permanent magnets in one embodiment, exerting a continuous magnetic force. The permanent magnets can be supplied or created from differing materials, depending on the exact configuration of the pump 10 and the temperatures associated with the operation of the pump 10, temperatures being one factor affecting magnetization. The continuous magnetic force may be supplied by other specific means—for example, by selectively using ferrous or other magnetizable material in place of one or more magnets. Any suitable magnet mechanism using permanent magnets or other means to exert the magnetic force may be used while remaining within the scope of the invention.

An outlet fitting 48 containing a discharge passage 49 is disposed in the housing above the outlet chamber 20. The outlet fitting 48 is fitted snugly against a seal washer 50. The discharge passage 49 serves as an outlet for the pump 10 and in one embodiment leads to a common rail for use in a diesel engine injection system.

Figure 4A:
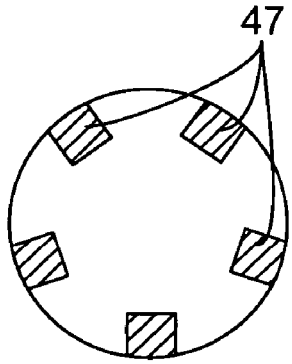
FIG. 4A is the same view as FIG. 4, illustrating another embodiment of the repelling magnet comprising a plurality of magnets.

FIG. 4A illustrates an alternative construction of the repelling magnet 46 by way of providing an example of alternative construction of the several magnets described herein while maintaining their function. The alternative construction of the repelling magnet 46 comprises a plurality of smaller magnets 47 disposed in annular arrangement at the top of the outlet chamber 20. Other arrangements and locations of the magnet 46 and other magnets described herein are also possible as long as they carry out the attracting/repelling functions necessary for operation of the pump.

Focusing now on the central bore 14 and its constituent parts, an annular fuel drain duct 52 is disposed in the housing 12 around the pressurizing chamber 16. A fuel drain 54 leads from the fuel drain duct 52 through the housing 12. The fuel drain duct 52 is intended to remove fuel from the system that might find its way between the pressurizing plunger 22 and the walls of the pressurizing chamber 16.

At the top of the pressurizing chamber 16, a first annular inlet seat 56 is provided at or near the location where the inlet plunger bulb 30 abuts the step 17. A second annular inlet seat 58 is also provided, above the first inlet seat 56, such that when the inlet plunger bulb or seating end 30 is urged upwards it abuts both inlet seats 56 and 58 in sealing engagement. Thus the inlet plunger 24 acts as a valve member, and the inlet seats 56 and 58 act as valve seats, the arrangement together forming an inlet valve.

An annular inlet chamber 60 is disposed between the inlet seats 56 and 58 by means of an annular concavity in that section of the housing 12. Alternatively, the inlet chamber could be formed by making the corresponding annular section of the bulb 30 concave, or both the housing and bulb. A fuel inlet 62 leads through the housing from a fuel supply (not shown) to the inlet chamber 60. A debris collection magnet 64 is provided in or near the inlet 62, as needed, to collect magnetic debris in the fuel stream that might otherwise collect within and/or interfere with the operation of the pump 10. Such debris might include metal shavings or particles arising from wear of components upstream of the pump 10. The other magnets in the pump 10—the inlet plunger magnet 32, outlet plunger magnet 40 and repelling magnet 46—also act as collectors of debris generated from the movement of the plungers 22, 24, and 26 within the central bore 14, as well as from other stresses on the system.

Figure 5:
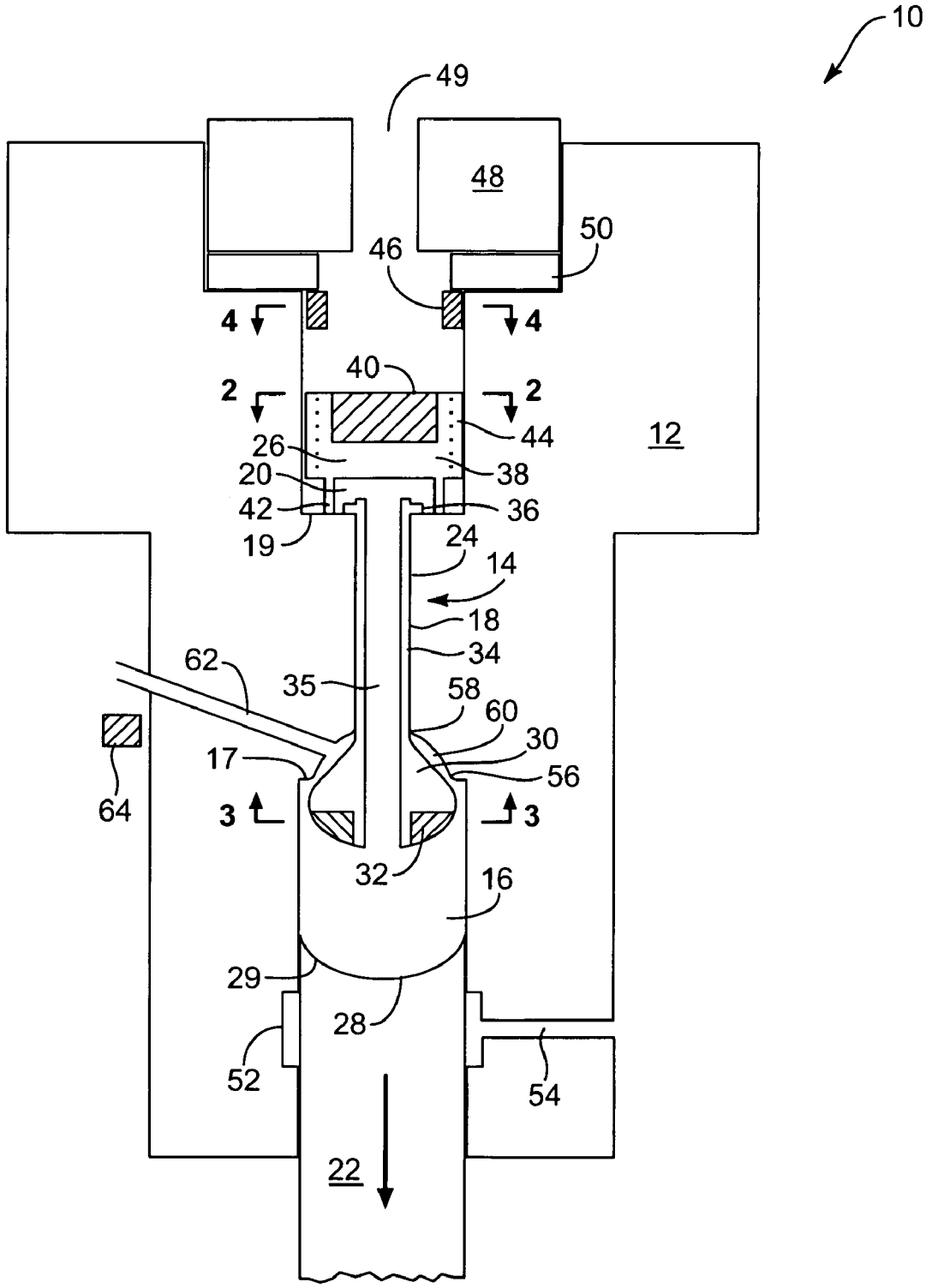
FIG. 5 is a cross-sectional view of the pump apparatus of FIG. 1, showing the pump in depressurizing or suction mode.

Focusing now on the operation of the pump 10, FIG. 1 shows the pump 10 in discharge (or pressurizing) mode, as it is discharging high-pressure fuel through the discharge passage 49 to the common rail. FIG. 5 shows the pump 10 in intake or filling mode, as it is taking in fuel through the fuel inlet 62.

Referring specifically to FIG. 5, in operation of the pump 10, fuel is fed into the fuel inlet 62, by a low pressure pump delivering fuel at approximately 60 to 200 psi or other means. The fuel fills the annular inlet chamber 60, presses against the inlet plunger bulb 30 and urges the inlet plunger 24 downward, away from the inlet seats 56 and 58 and into the pressurizing chamber 16. The stroke limiter 36 prevents over-travel of the inlet plunger 24 by abutting the outlet step 19—however, in practice, if the timing of the reciprocal plunger strokes of the system is properly adjusted and pump 10 otherwise calibrated, the other forces working on the inlet plunger 24 should prevent the need for the stroke limiter 36 to abut the outlet step 19, by means of causing the inlet plunger 24 to rise before abutment occurs. As noted above, the inlet plunger shaft 34 is fitted snugly against the walls of the central passage 18 in order to prevent fuel from traveling there between and thus to restrict fluid flow from the annular inlet chamber 60 to the pressurizing chamber 16.

The fuel travels from the inlet chamber 60 in a path around the bulb 30 to the pressurizing chamber 16, filling it and urging the pressurizing plunger 22 downward. That urging force may be in addition to whatever mechanism, previously mentioned, that the user may choose to drive the plunger 22 in reciprocating motion.

When the pressurizing plunger 22 reaches the bottom of its stroke, the pressurizing chamber 16 is filled with fuel and there remains little or no pressure imbalance between the pressurizing chamber 16 and the inlet chamber 60, allowing the inlet plunger 24 to rise, under the attractive influence of inlet plunger magnet 32 and outlet plunger magnet 40, and abut the inlet seats 56 and 58 in sealing engagement, as shown in FIG. 1.

Referring again to FIG. 1, when pressurizing plunger 16 begins its upward stroke the fuel is pressurized in the pressurizing chamber 16, further urging the inlet plunger bulb 30 in sealing engagement against the inlet seats 56 and 58 and urging the fuel through the inlet plunger channel 35. The pressurized fuel presses against the outlet plunger body 38 and seating annulus 42, forcing them upward and breaking the seal between the seating annulus 42 and step 19. With the seal broken, a fluid communication passage is opened and the fuel flows around the seating annulus 42, upward through the passages 42 in the outlet plunger 26, and thence through the discharge passage 49 into the common rail or common-rail connection portion of the system.

As the pressurized fuel flows into the discharge passage 49, the relative pressure forcing outlet plunger 26 upwards is lessened. Eventually the attractive force between the inlet plunger magnet 32 and outlet plunger magnet 40, as well as the repelling force between the outlet plunger magnet 40 and the repelling magnet 46, overcome the lessening fluid pressure and the outlet plunger 26 drops to seal again against the step 19. The forces acting on the outlet plunger 26 are also impacted by the timing of the reciprocal stroke of pressurizing plunger 22, to wit, the time at which it reaches the top of its stroke and begins to descend. The system thus again reaches the state depicted in FIG. 5, and the cycle begins anew.

It can be seen that the inlet plunger 24 and outlet plunger 26 operate as an inlet valve and an outlet valve, respectively, without the need for springs or other mechanical devices to urge them against their valve seats. Instead, that function is carried out by the continuous attractive/repelling forces between the magnets 32, 40, and 46.

Figure 6:
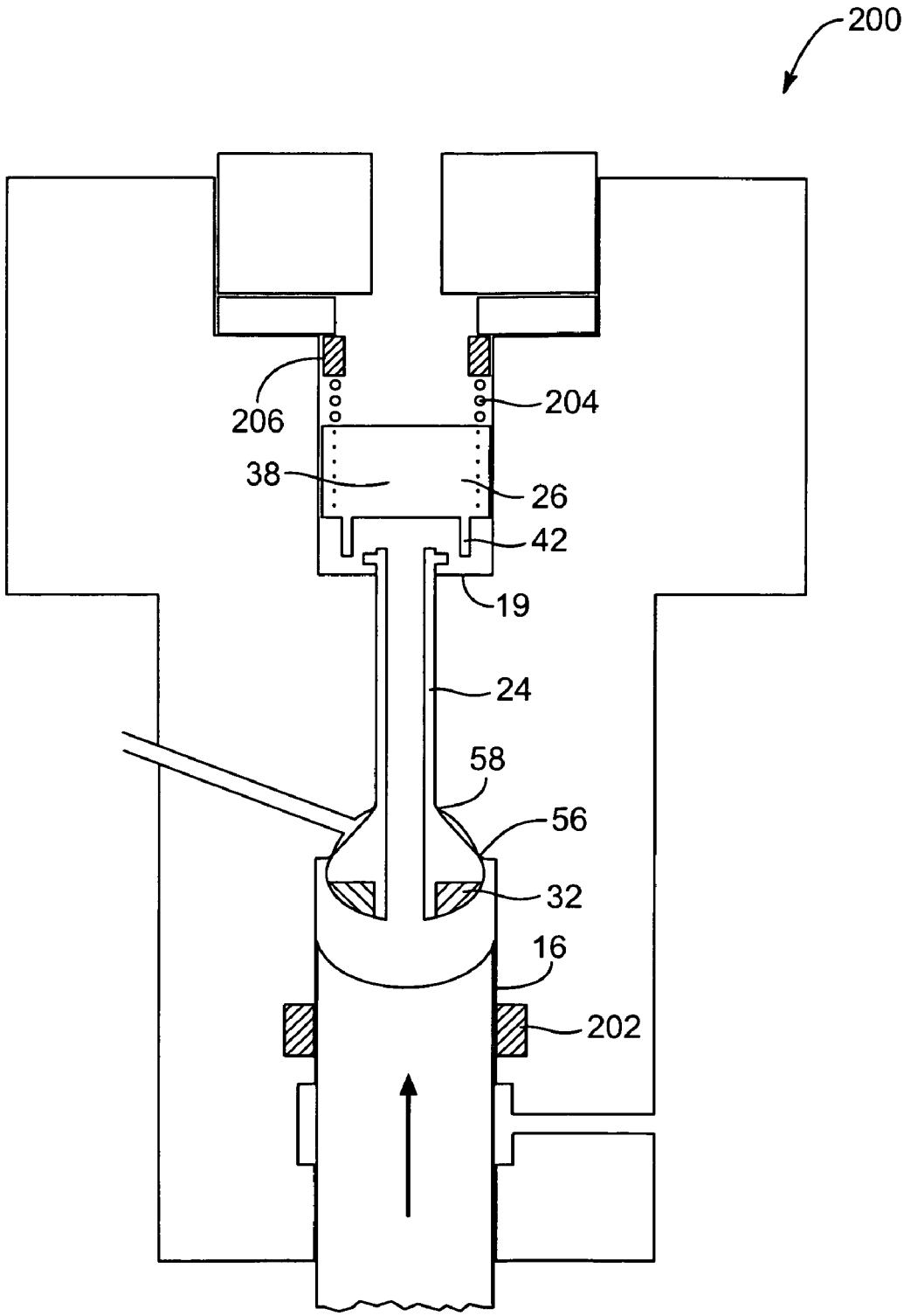
FIG. 6 is a cross-sectional view illustrating another embodiment of a high-pressure fuel pump apparatus in accordance with the invention.

Referring now to FIG. 6, another embodiment of the invention is shown, somewhat similar in structure and operation to the pump 10, with like numerals describing like structures and with differences as described below.

In this embodiment, a pump 200 comprises an annular repelling magnet 202 positioned concentrically outside the pressurizing chamber 16 and below the inlet plunger magnet 32. The outlet plunger 26 does not contain a magnet, nor is there a repelling magnet positioned in the outlet chamber 20. A spring 204 is positioned between the outlet plunger body 38 and an annular spring base 206, the spring base 206 being positioned above the outlet plunger 26 and against the seal washer 50.

In operation, the inlet plunger 24 is urged against the seats 56 and 58 through a repelling force exerted between the inlet plunger magnet 32 and the annular repelling magnet 202. With regard to the outlet plunger 26, the outlet plunger seating annulus 42 is urged against the step 19 by conventional means, to wit, the spring 204 exerts downward pressure against the plunger body 38.

It can be seen, then, that means already known to those skilled in the art may be combined with aspects of the present invention in construction of pump apparatuses in accordance with the invention. Other arrangements and constructions of the pump apparatus are also possible, and will be apparent in light of this disclosure.

Figure 7:
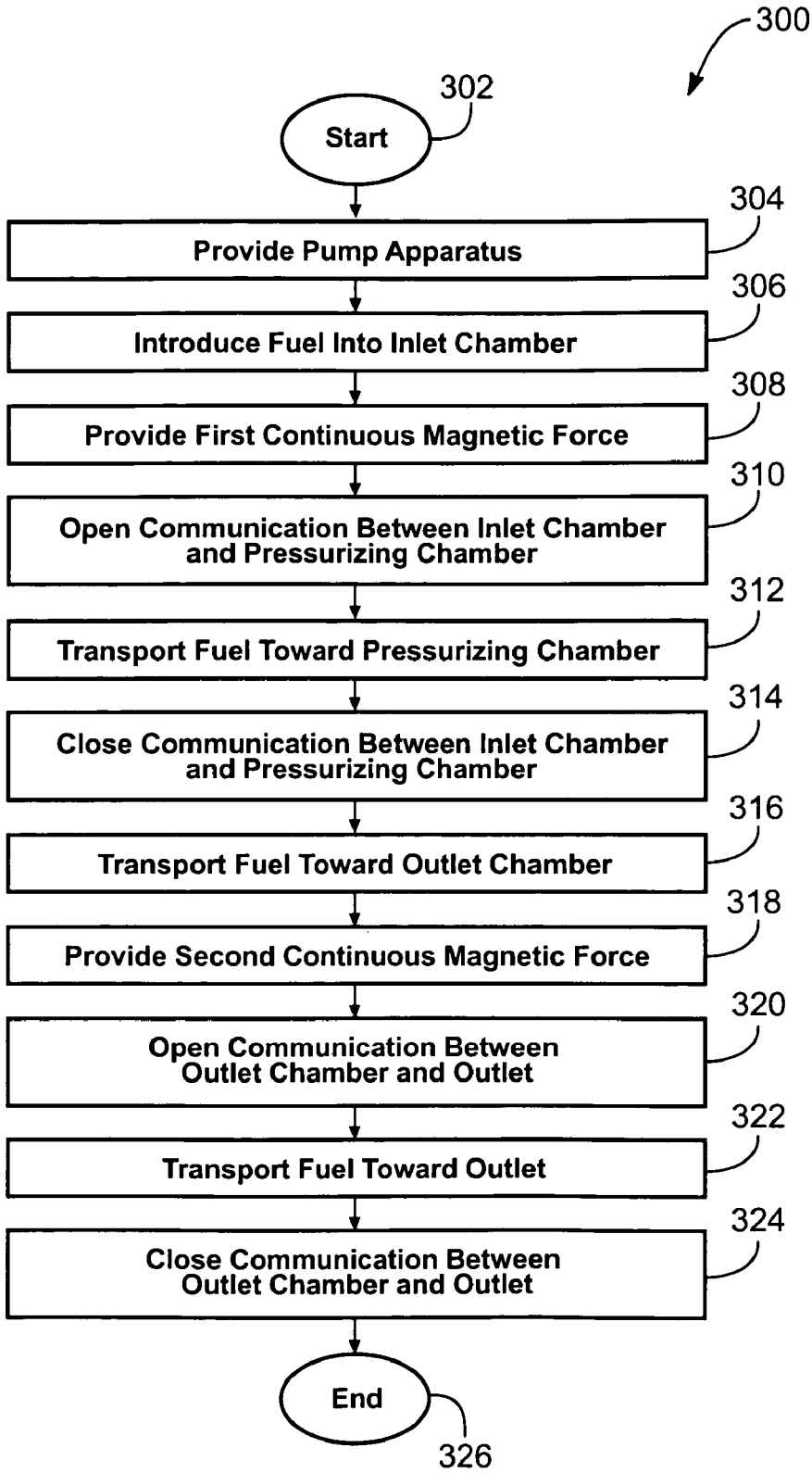
FIG. 7 is a schematic flow chart diagram illustrating one embodiment of a fluid pumping method in accordance with the present invention.

Turning now to a particular method embodiment of the invention, the schematic flow-chart diagram shown in FIG. 7 is generally set forth as a logical flow chart, with the depicted order and labeled steps indicative of the method embodiment. Other steps and methods may be conceived that are equivalent in function, logic, or effect to one or more steps, or portions thereof, of the illustrated method. Additionally, the format and symbols employed are provided to explain the logical steps of the method and should be understood not to limit the scope of the method. Although various arrow types and line types may be employed in the flow chart diagram, they are understood not to limit the scope of the corresponding method; some arrows or other connectors may be used to indicate only the logical flow of the method. For instance, an arrow may indicate a waiting or monitoring period of unspecified duration between enumerated steps of the depicted method. Additionally, the order in which a particular method according to the invention occurs may or may not strictly adhere to the order of the corresponding steps shown.

Referring now to FIG. 7, a particular method embodiment 300 of the invention is depicted. The method first comprises starting the process as depicted in a block 302. As depicted in a block 304, a high-pressure fuel pump apparatus, such as the pump apparatus 10 depicted in FIGS. 1-5, is provided. Fuel from any suitable supply source is introduced into an inlet chamber within the pump apparatus, as depicted in a block 306. The inlet chamber may be annular, as depicted by the annular inlet chamber 60 in FIGS. 1-5, or any other suitable shape or construction.

As depicted in a block 308, a first continuous magnetic force is provided that blocks communication between the inlet chamber and a pressurizing chamber situated within the pump apparatus. This force may be provided by a configuration of permanent magnets or magnetizable material. In an apparatus embodiment of the invention, depicted in FIGS. 1-5, the force is provided by means of the attractive force between the inlet plunger magnet 32 and the outlet plunger magnet 40.

A block 310 depicts the opening of communication between the inlet chamber and the pressurizing chamber, against the influence of the continuous magnetic force. The magnetic force may be overcome by any convenient means, be it hydraulic force, mechanical connection, an opposing magnetic force or other means. In the apparatus described in FIGS. 1-5, the relative fluid pressures within the inlet chamber 60 and the pressurizing chamber 22, at least partially caused by the low-pressure fuel filling the inlet chamber 60 and the downward motion of the pressurizing plunger 22, force the inlet plunger 24 downward against the attractive magnetic force between the inlet plunger magnet 32 and the outlet plunger magnet 40. Any type of communication passage between the inlet chamber and pressurizing chamber, however, will be sufficient to carry out this aspect of the invention method.

As depicted in a block 312, the fuel is then transported from the inlet chamber to the pressurization chamber. In the apparatus described in FIGS. 1-5, driven by differential fluid pressures the fuel is allowed to flow from the inlet chamber 60, around the inlet plunger bulb 30, and into the pressurizing chamber 22.

Communication between the inlet chamber and pressurizing chamber is then closed, at least partially under the influence of the first continuous magnetic force, as depicted in a block 314, and the fuel is transported toward an outlet chamber provided in the pump apparatus, as depicted in a block 316. In the apparatus embodiment described above, the pressurizing plunger 22 moves upward in its reciprocating stroke, pressurizing the fuel and forcing it through the inlet plunger channel 35 to the outlet chamber 20, though the fuel can be transported by any convenient means.

A block 318 depicts the providing of a second continuous magnetic force that prevents communication between the outlet chamber and a discharge outlet—for example, the repellent force between the outlet plunger magnet 40 and the repelling magnet 46, as well as the attractive force between the outlet plunger magnet 40 and the inlet plunger magnet 32. Other configurations are also possible. It will also be apparent that the first magnetic force and the second magnetic force may be one and the same, depending on the configuration used to supply the force(s). For example, the repelling magnet 46 could be removed, causing the apparatus to rely solely on the attractive force between the outlet plunger magnet 40 and the inlet plunger magnet 32 in order to block communication between the inlet chamber 60 and pressurizing chamber 16—by urging the inlet plunger bulb 30 against the first and second inlet seats 56 and 58—and to close communication between the outlet chamber 20 and discharge passage 49—by urging the outlet plunger seating annulus 42 in sealing engagement against the outlet step 19.

A block 320 depicts the opening of communication between the outlet chamber and the discharge outlet against the influence of the second magnetic force. The second magnetic force may be overcome by any suitable means. In one embodiment, the second magnetic force is overcome by pressurized fluid under the influence of the pressurizing plunger 22 pushing the outlet plunger body 38 and seating annulus 42 away from the outlet step 19.

A block 322 depicts transporting the fuel from the outlet chamber toward a discharge outlet, which in one embodiment is connected to a high-pressure common rail for injection into a diesel engine. In the embodiment described in FIGS. 1-5, the pressurized fuel flows from the inlet plunger channel 35, around the outlet plunger seating annulus 42, through the outlet plunger passages 44 and into the discharge passage 49. Communication between the outlet chamber and pressurizing chamber is then closed, as depicted in a block 324, at least partially under the influence of the second continuous magnetic force. In one embodiment described above, the attractive magnetic force between the magnets 40 and 32, and the repellent force between the magnets 40 and 46, help close the outlet plunger seating annulus 42 against the outlet step 19. The method 300 then ends, as depicted in a block 326.

It will be apparent from the above description of one embodiment of the invention method, together with certain apparatus embodiments disclosed herein, that some steps of the method may be eliminated while remaining within the scope of the invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for pumping a fluid, the apparatus comprising:

a housing;

an inlet, through which the fluid enters the housing;

an outlet, through which the fluid leaves the housing;

a valve, comprising a valve member and a valve seat, the valve being positioned between the inlet and the outlet such that the fluid from the inlet must flow through the valve to reach the outlet; and a magnet mechanism, configured to exert a continuous magnetic force, the magnet mechanism being positioned to continuously urge the valve member into a first position;

wherein the valve member and the valve seat form an inlet valve, and further comprising an outlet valve having an outlet valve member and an outlet valve seat.

2. The apparatus of claim 1, wherein the magnet mechanism is configured to urge the valve member against the valve seat.

3. The apparatus of claim 1, wherein the magnet mechanism comprises a permanent magnet.

4. The apparatus of claim 3, wherein the permanent magnet is disposed on the valve member, and further comprising an attractor, the attractor being configured to exert an attractive force on the permanent magnet, and wherein the valve seat is disposed substantially between the permanent magnet and the attractor.

5. The apparatus of claim 3, further comprising an attractor disposed on the valve member, the attractor being configured to exert an attractive force on the permanent magnet, and wherein the valve seat is disposed substantially between the attractor and the permanent magnet.

6. The apparatus of claim 3, further comprising a repeller, the repeller being configured to exert a repellent force on the permanent magnet, and wherein the permanent magnet is disposed on the valve member substantially between the repeller and the valve seat.

7. The apparatus of claim 3, further comprising a repeller, the repeller being configured to exert a repellent force on the permanent magnet, and wherein the repeller is disposed on the valve member substantially between the permanent magnet and the valve seat.

8. The apparatus of claim 1, wherein the inlet valve seat and outlet valve seat are disposed substantially between the inlet valve member and the outlet valve member, the valve members being enabled to move in reciprocating motion along a substantially common axis, and wherein the magnet mechanism comprises a first permanent magnet disposed on one of the valve members and an attractor disposed on the other valve member, the attractor being configured to exert an attractive force on the permanent magnet, such that the attractive force between the first permanent magnet and the attractor urges the inlet valve member against the inlet seat and the outlet valve member against the outlet seat.

9. The apparatus of claim 8, wherein the first permanent magnet is disposed on the outlet valve member and the attractor is disposed on the inlet valve member, and further comprising a second permanent magnet oriented to repel the first permanent magnet, the first permanent magnet being positioned substantially between the second permanent magnet and the outlet seat.

10. The apparatus of claim 8, wherein an outlet annulus is attached to the outlet valve member, the outlet annulus being configured to abut the outlet seat when the outlet valve moves toward the outlet seat.

11. The apparatus of claim 8, wherein the valve members and valve seats are disposed substantially within a central bore and substantially along a common axis, and wherein the inlet valve member comprises a shaft and a seating end disposed at a first axial end of the shaft, the seating end being configured to form an annular inlet chamber between the seating end and the housing when the seating end abuts the inlet valve seat, and further comprising a stroke limiter disposed at or near a second axial end of the shaft, with the shaft extending through the central bore substantially between the inlet seat and the outlet seat, and wherein the stroke limiter is configured to limit the axial motion of the inlet valve member by abutting the housing as the inlet valve seating end moves away from the inlet valve seat, and further comprising a channel disposed through the length of the inlet valve member and a plurality of passages through the outlet valve member, the passages being configured to allow for movement of fluid through the outlet valve member.

12. The apparatus of claim 8, further comprising a pressurizing plunger positioned substantially within the central bore and along the common axis, the pressurizing plunger being configured to move in reciprocating fashion within the central bore, a first end of the pressurizing plunger being substantially concave and positioned axially near the inlet valve member, such that a chamber is formed between the first end of the pressurizing plunger and the inlet valve member when the two are spaced from each other in the course of their reciprocating motion.

13. A high-pressure common-rail fuel injection pumping system, the system comprising:

a pump housing;

a fuel inlet, through which the fuel enters the housing;

a fuel outlet, through which the fuel leaves the housing;

a common rail attached to the fuel outlet in fluid engagement, the common rail configured to receive high-pressure fuel from the fuel outlet;

a plurality of injectors configured to receive fuel from the common rail and inject the fuel into an engine;

a valve, comprising a valve member and a valve seat, the valve being positioned between the fuel inlet and the fuel outlet such that the fuel from the fuel inlet must flow through the valve to reach the fuel outlet; and a magnet mechanism, configured to exert a continuous magnetic force, the magnet mechanism being positioned to continuously urge the valve member into a first position.

14. A valve, comprising:

a housing having a bore;

a first valve member and a second valve member;

a first valve seat and a second valve seat, the valve members and valve seats disposed along a common axis in the bore; and a magnet mechanism configured to exert a continuous magnetic force urging the first valve member into a first position relative to the first valve seat, the magnet mechanism configured to exert a continuous magnetic force urging the second valve member in a direction along the common axis relative to the first valve member.

15. The valve of claim 14, wherein the first position of the valve member is positioned against the valve seat, in sealing engagement.

16. An apparatus for pumping a fluid, the apparatus comprising a housing;

a central bore having a central axis, the central bore having first, second and third sections, the first and third bore sections being radially larger than the second section so as to form an inlet step at the conjunction of the first and second central bore sections and an outlet step at the conjunction of the second and third central bore sections;

a pressurizing plunger adapted for reciprocating motion within the first central bore section;

a fuel inlet disposed in the housing, the fuel inlet leading from a fuel source to an inlet chamber;

an inlet plunger disposed within the central bore and adapted for reciprocating movement along the central axis, the inlet plunger containing an internal channel disposed substantially along the central axis, the inlet plunger further comprising first and second sections disposed axially from each other, the first section being radially larger than the second section and positioned substantially within the first central bore section and adapted to abut the inlet step, the second plunger section being positioned through the second bore section;

an outlet plunger disposed substantially within the third central bore section and axially movable therein, one end of the outlet plunger comprising an annulus adapted to abut the outlet step, the outlet plunger further comprising a fluid passage, the fluid passage being positioned through the outlet plunger and further positioned radially outward of the annulus; and a magnet mechanism configured to continuously urge at least one of the plungers into a first position.

17. The apparatus of claim 16, wherein the magnet mechanism is configured to exert a continuous magnetic force.

18. The apparatus of claim 16, wherein the end of the pressurizing plunger nearest the inlet step is substantially concave.

19. The apparatus of claim 16, wherein the magnet mechanism comprises a permanent magnet.

20. The apparatus of claim 16, wherein the magnet mechanism comprises a first permanent magnet disposed on the inlet plunger and further comprising a second permanent magnet disposed on the outlet plunger.

21. The apparatus of claim 20, further comprising a third permanent magnet located within the housing, the third permanent magnet being positioned such that the second permanent magnet is positioned substantially between the first and third permanent magnets.

22. A method of pumping a fluid, the method comprising:

providing a first fluid chamber, a second fluid chamber, a first passage disposed between the first and second fluid chambers, and a magnetic force continuously urging the first passage closed;

providing a third fluid chamber and a second passage, the second passage being disposed between the second and third fluid chambers, wherein the magnetic force continuously urges the second passage closed;

opening the first passage against the influence of the magnetic force, allowing for fluid communication between the first fluid chamber and the second fluid chamber;

transporting fluid from the first fluid chamber to the second fluid chamber; and closing the first passage at least partially under the influence of the magnetic force.

23. The method of claim 22, further comprising opening the second passage against the influence of the magnetic force, allowing for fluid communication between the second fluid chamber and the third fluid chamber, transporting fluid from the second fluid chamber to the third fluid chamber, and closing the second passage at least partially under the influence of the magnetic force.

24. The method of claim 22, further comprising providing a second magnetic force continuously urging second passage closed, opening the second passage against the influence of the second magnetic force allowing for fluid communication between the second fluid chamber and the third fluid chamber, transporting fluid from the second fluid chamber to the third fluid chamber, and closing the second passage at least partially under the influence of the second magnetic force.

25. The method of claim 22, wherein opening the passage comprises urging a valve member away from a valve seat against the influence of the magnetic force, and closing the passage comprises urging the valve member toward the valve seat at least partially under the influence of the magnetic force.

26. An apparatus for pumping a fluid, the apparatus comprising:

a housing having a central bore;

an inlet, through which the fluid enters the housing;

an outlet, through which the fluid leaves the housing;

a valve, comprising a valve member and a valve seat on a common axis, the valve being positioned between the inlet and the outlet such that the fluid from the inlet must flow through the valve to reach the outlet;

a magnet mechanism, configured to exert a continuous magnetic force, the magnet mechanism being positioned to continuously urge the valve member into a first position; and a pressurizing plunger positioned substantially within the central bore and along the common axis.

27. An apparatus for pumping a fluid, the apparatus comprising a housing;

a central bore having a central axis, the central bore having first, second and third sections, the first and third bore sections being radially larger than the second section so as to form an inlet step at the conjunction of the first and second central bore sections and an outlet step at the conjunction of the second and third central bore sections;

a pressurizing plunger adapted for reciprocating motion within the first central bore section;

a fuel inlet disposed in the housing, the fuel inlet leading from a fuel source to the first section;

a first valve member disposed substantially within the first central bore section and adapted to abut the inlet step, the second plunger section being positioned through the second bore section;

a second valve member disposed substantially within the third central bore section and adapted to abut the outlet step; and a magnet mechanism configured to continuously urge at least one of the valve members into a first position.

* * * * *

UNITED STATES PATENT AND TRADEMARK OFFICE

CERTIFICATE OF CORRECTION

PATENT NO. : 7,328,688 B2
APPLICATION NO. : 11/151927
DATED : February 12, 2008
INVENTOR(S) : Howard S. Savage et al.

It is certified that error appears in the above-identified patent and that said Letters Patent is hereby corrected as shown below:

Column 13, line 16

"continuously urging second" should read --continuously urging the second--

Signed and Sealed this

Twenty-seventh Day of May, 2008

JON W. DUDAS
*Director of the United States Patent and Trademark Office*